US005609532A

United States Patent [19]

Chikaraishi

[11] Patent Number: 5,609,532

[45] Date of Patent: Mar. 11, 1997

[54] THREAD-WOUND GOLF BALL

[75] Inventor: Toshio Chikaraishi, Akishima, Japan

[73] Assignee: Bridgestone Sports Co., Ltd., Tokyo, Japan

[21] Appl. No.: 541,262

[22] Filed: Oct. 12, 1995

Related U.S. Application Data

[63] Continuation-in-part of Ser. No. 271,969, Jul. 8, 1994, abandoned.

[30] Foreign Application Priority Data

Jul. 8, 1993 [JP] Japan ..... 5-193066

[51] Int. Cl.[6] ..... A63B 37/06; A63B 37/12; A63B 37/14

[52] U.S. Cl. ..... 473/365; 473/384

[58] Field of Search ..... 473/356, 357, 473/358, 362, 364, 365, 366, 383, 384, 359; 273/222–227

[56] References Cited

U.S. PATENT DOCUMENTS 5,338,034 8/1994 Cadorniga ..... 473/365 X
5,467,994 11/1995 Moriyama et al. ..... 473/365 X

*Primary Examiner*—George J. Marlo
*Attorney, Agent, or Firm*—Sughrue, Mion, Zinn, Macpeak & Seas

[57] ABSTRACT

A thread-wound golf ball includes a wound core (3) consisting of a center (1) and a thread rubber layer (2) thereon, and a cover (4) having a plurality of dimples (5). The core (3) wherein the thread rubber layer (2) has a thickness of 5 to 9 mm and a larger weight than the center (1) is enclosed in the cover (4) made of an ionomer resin having a thickness of 1 to 2.5 mm and a Shore D hardness of 52 to 68. The ball has an outer diameter of 42.9 to 46 mm. The total volume of dimples is 300 to 400 $mm^3$. The ball having a relatively large diameter and an increased amount of thread rubber provides an increased flying distance and improved feeling on impact.

4 Claims, 1 Drawing Sheet

THREAD-WOUND GOLF BALL

CROSS REFERENCE TO RELATED APPLICATION

This application is a continuation-in-part of application Ser. No. 08/271,969 filed on Jul. 8, 1994, now abandoned, the entire contents of which are hereby incorporated by reference.

BACKGROUND OF THE INVENTION

1. Field of the Invention

This invention relates to a thread-wound golf ball which is improved in flying distance and hitting feel.

2. Prior Art

The R&A Standards prescribe that golf balls shall have a diameter of at least 42.67 mm and a weight of at most 45.93 grams. The upper limit of diameter and the lower limit of weight are not specified. Any golf ball meets the Standards as long as it is 42.67 mm or larger in diameter and 45.93 grams or lower in weight.

However, in general practice, since it is desired for golf balls to reduce the aerodynamic resistance on trajectory for improving the flying performance, golf balls are manufactured such that they are small enough, but the ball diameter is not smaller than 42.67 and they are heavy enough, but the ball weight does not exceed 45.93 grams. More particularly, thread-wound golf balls are generally manufactured by winding thread rubber on a center having an outer diameter of 26 to 32 mm and a weight of 17 to 22 grams to form a wound core, which is covered with a resin to a thickness of 1.5 to 2.0 mm.

These wound golf balls are good in feeling and controllability, but they travel less distance when hit by less powerful players. Also undesirably, when hit off center, the wound balls are receptive to extra spin components like side spin, which detract from the flying distance.

A number of two-piece golf balls are now on the market. They are characterized by an increased flying distance as compared with the wound golf balls. This tendency becomes salient in slow head speed regions. With a choice of two-piece golf balls, less powerful players will be satisfied with an increased flying distance. However, the two-piece golf balls are poor in hitting feel because of hardness as compared with the wound golf balls and tend to roll further on the green because of minimized spin.

Therefore, golf balls which provide a pleasant feeling on impact and good control-lability like the wound golf balls and offer a substantial flying distance like the two-piece golf balls are desirable for less powerful golfers and golfers who swing at a low head speed.

SUMMARY OF THE INVENTION

An object of the present invention is to provide a thread wound golf ball which offers a satisfactory flying distance and a pleasant feeling on impact even when hit by less powerful players.

In connection with a thread wound golf ball in which a wound core consisting of a center and a thread rubber layer is enclosed by a cover having a plurality of dimples thereon, the inventors have found that when the thread rubber layer has a thickness of 5 to 9 mm and a greater weight than the center, preferably by a weight difference of 0.1 to 15 grams, and the cover of an ionomer resin having a Shore D hardness of 52 to 68 is applied to the core to a thickness of 1 to 2.5 mm, and the ball has a larger outer diameter of 42.9 to 46 mm than the conventional large size balls and the total volume of dimples is 300 to 400 $mm^3$, there are achieved substantial improvements in flying distance and hitting feel.

In general, as the outer diameter increases, the flying distance decreases due to aerodynamic resistance. By increasing the amount of thread rubber in response to an increase in outer diameter, there are achieved an increase of initial speed, a decrease of spin, and an increase of ejection angle, which are useful settings for increasing the flying distance. By increasing the proportion of the thread rubber layer so that the thread rubber layer has a thickness of 5 to 9 mm and a larger weight than the center of the core and by adjusting the total volume of dimples to 300 to 400 $mm^3$, not only repulsion is improved, which is effective for increasing the flying distance that the ball covers when hit at low head speeds, but also hitting-feel is substantially improved over the conventional wound golf balls having an ionomer resin cover. Balls having a larger outer diameter than the conventional golf balls are unlikely to sink in the grass, are easier to aim at, and produce a greater inertia moment so that the balls roll in a stable path on putting.

According to the present invention, there is provided a thread-wound golf ball comprising a wound core consisting of a center and a thread rubber layer thereon, and a cover enclosing the core and having a plurality of dimples thereon. The thread rubber layer has a thickness of 5 to 9 mm and a greater weight than the center of the core. Preferably, the thread rubber layer is heavier than the center portion of the core by 0.1 to 15 grams, more preferably by 1 to 10 grams. The cover is made of an ionomer resin and has a thickness of 1 to 2.5 mm and a Shore D hardness of 52 to 68. The ball has an outer diameter of 42.9 to 46 mm, preferably 44 to 46 mm. The total volume of dimples is 300 to 400 $mm^3$.

BRIEF DESCRIPTION OF THE DRAWINGS

The sole figure.

DETAILED DESCRIPTION OF THE INVENTION

Figure 1:
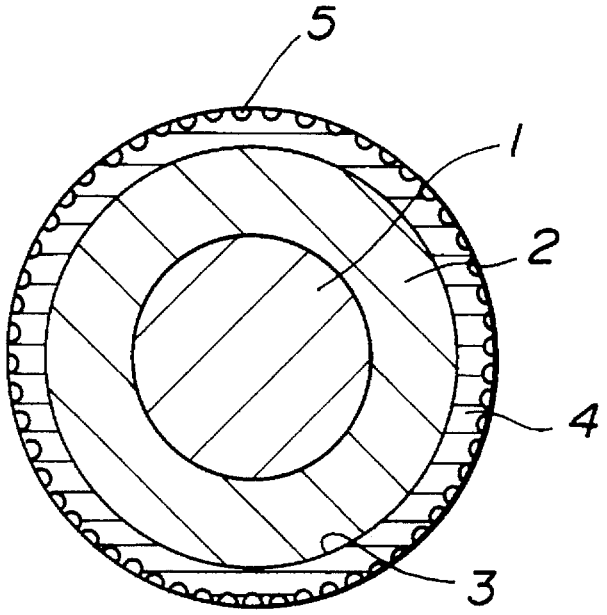
FIG. 1 is a schematic cross section of a thread-wound golf ball.

Referring to FIG. 1, the thread-wound golf ball of the invention includes a wound core 3 including a generally spherical center portion 1 and a thread rubber layer 2 enclosing the outer surface of the center portion 1. A cover 4 encloses the wound core 3 and has a plurality of dimples 5. According to the invention, the thread rubber layer 2 heavier than the center portion 1 of the wound core 3.

The center 1 may be either a solid center or a liquid center. The preferred solid center is a solid rubber core and the preferred liquid center is a liquid center in the form of a vulcanized rubber bag filled with liquid.

The rubber used in the solid center is preferably a high cis polybutadiene rubber having high repulsion though not limited thereto. For example, the solid center is prepared by kneading 100 parts by weight of high cis polybutadiene rubber, 1 to 3 parts by weight of organic peroxide, and an appropriate amount of a weight control agent in a Banbury mixer or roll mill, and molding and vulcanizing the mix at 155° to 165° C. for 10 to 25 minutes. The vulcanizing agent used herein may be sulfur instead of the organic peroxide. Any of weight control agents, for example, zinc oxide, barium sulfate, silica, and calcium carbonate and mixtures thereof may be used.

Also useful is a liquid center which is generally prepared by forming a bag of conventional vulcanized rubber and filling the bag with water or a paste obtained by adding barium sulfate and a minor amount of ethylene glycol to water. The vulcanized rubber bag is preferably 1.5 to 2.5 mm in gage.

The center 1, which is formed lighter than thread rubber layer 2, preferably has a weight of 8 to 18 grams, more preferably 11 to 16 grams though not limited thereto. With a center weight of more than 18 grams, it would be difficult to construct a golf ball meeting the weight requirement. For a center weight of less than 8 grams, a choice of center material is limited and it is sometimes difficult to form such an extremely light center. When it is desired to form a center having a diameter of about 26 mm, for example, a center material having a specific gravity of less than 0.9 must be used in order that the center weight be less than 8 grams. It is then quite difficult to form such a center because most rubber materials conventionally used in the center have a specific gravity of more than 0.9. The center portion 1 may have a diameter of 24 to 32 mm, especially 26 to 30 mm.

The thread rubber layer 2 is formed by winding thread rubber around the outer periphery of the center portion 1 under high tension. The thread rubber layer 2 has a larger weight than the center portion 1. Preferably the thread rubber layer has a weight of 16 to 26 grams, especially 17 to 22 grams. If the thread rubber layer is lighter than 16 grams, the entire ball would have a too lower weight to provide flying performance because the center is lighter than the thread rubber layer. If the thread rubber layer is heavier than 26 grams, it would be difficult to construct a golf ball meeting the weight requirement. The thread rubber layer has a radial thickness of 5 to 9 mm, especially 6 to 7 mm. The thread rubber layer forms with the center the wound core which may have an outer diameter of 39 to 43 mm. The thread rubber used in the thread rubber layer may be conventional one used in golf balls.

In the wound core 3 consisting of the center portion 1 and the thread rubber layer 2, the weight of the thread rubber layer 2 is greater than the weight of the center portion 1 preferably by a weight difference of 0.1 to 15 grams, especially 0.3 to 10 grams. With a weight difference of less than 0.1 gram, repulsion would be low whereas with a weight difference of more than 15 grams, it would be difficult to construct a golf ball meeting the weight requirement. When a ball having an outer diameter of 44 to 46 mm is desired, the weight difference should preferably be 1 to 10 grams because an increase in flying distance is ensured.

On the wound core 3, the cover 4 of ionomer resin is applied to a radial thickness of 1 to 2.5 mm, preferably 1.2 to 2.3 mm to complete a wound golf ball according to the invention. A cover of less than 1 mm thick is less resistant against cut and tends to be torn when hit at the top by iron shots. With a thickness of more than 2.5 mm, the cover is too thick and provides a hard touch to detract from hitting feel. The ionomer resin of which the cover 4 is formed may be conventional one used in golf ball covers, although ionomer resins having a Shore D hardness of 52 to 68 are preferred so that the cover has a Shore D hardness of 52 to 68, especially 54 to 65. With a Shore D hardness of less than 52, a flying distance would be lowered. Exemplary ionomer resins are Surlyn 1557, 1605, 1555 and 1706 commercially available from E.I. dupont. They may be used alone or in admixture of two or more.

The wound golf ball is completed by covering the wound core 3 with the ionomer resin cover 4 while forming dimples in the cover. The dimples may be distributed in any of geometrical arrangements including 8-sided and 20-sided polygonal patterns. The dimples may be of any desired shape including square, hexagon, pentagon, and triangle shapes.

The number of the dimples is preferably 300 to 500, more preferably 360 to 460. Each dimple may preferably has a diameter of 2.0 to 4.2 mm, especially 2.6 to 4.0 mm and a depth of 0.16 to 0.24 mm, especially 0.18 to 0.22 mm.

The total volume of the dimples is 300 to 400 $mm^3$, more preferably 320 to 380 $mm^3$. If the total volume of the dimples is less than 300 $mm^3$, the flying distance is lowered because of a higher trajectory. If the total volume of the dimples is more than 400 $mm^3$ the flying distance is lowered because of a lower trajectory.

By combining the center portion 1, thread rubber layer 2 and cover 4 as mentioned above, the wound golf ball is completed to an outer diameter of 42.9 to 46 mm, preferably 43 to 46 mm, more preferably 43.5 to 46 mm. If the outer diameter exceeds 46 mm, it is sometimes difficult to limit the total weight within the weight requirement. If the outer diameter is less than 42.9 mm, the golf ball has substantially the same size as in the conventional ones and therefore the object of the present invention is not attained. The golf ball may have a total weight of 44.8 to 45.93 grams though not limited thereto.

The thread-wound golf ball of the invention offers a satisfactory flying distance and a pleasant feeling on impact even when it is hit by less powerful players who swing at a slow head speed. The ball is unlikely to sink in the grass, is easier to aim at, and produces a greater inertia moment to ensure stable rolling on putting.

EXAMPLE

Examples of the present invention are given below by way of illustration and not by way of limitation.

It is to be noted that the outer diameter of a golf ball is the diameter if the ball has true sphericity. As is well known in the art, it is very difficult to manufacture truly spherical balls and most golf balls have more or less distortion. In the following Examples and Comparative Examples, the outer diameter was measured at five pairs of points on the ball excluding dimples and an average of five measurements was calculated. The weight difference between the center and the thread rubber was determined by measuring the weights of the wound core (consisting of center and thread rubber layer) and the center and calculating from the difference.

Example 1

A mixture of high cis polybutadiene rubber/zinc white/zinc acrylate/barium sulfate/dicumyl peroxide in a weight ratio of 100/10/10/77/1.5 was fully milled and vulcanized at 160° C. for 20 minutes to form a solid center. Using this solid center, a 50/50 natural rubber/isoprene rubber mixture as thread rubber, and an ionomer resin (a 50/50 mixture of Surlyn 1706/Surlyn 1605, Shore D hardness 66 degrees) as a cover, wound golf balls were prepared to the specifications shown in Table 1. The golf balls were evaluated for MOI (inertia moment), coefficient of repulsion, flying characteristics, and hitting feel. The results are also shown in Table 1. The flying characteristics and hitting feel were measured and evaluated by the following tests.

Flying characteristics

Using a swing robot manufactured by True Temper Co., the ball was hit by a driver (W1, loft 10°) at a head speed of 40 m/s to measure a carry and a total flying distance. Under these hitting conditions, initial speed, ejection angle and spin were measured.

Feeling

A blind test was made by professional golfers who hit the ball with W#1 and evaluated the feeling at impact.

Example 2

A mixture of high cis polybutadiene rubber/zinc white/zinc acrylate/barium sulfate/dicumyl peroxide in a weight ratio of 100/10/10/33/1.5 was fully milled and vulcanized at 160° C. for 20 minutes to form a solid center. By the same procedure as in Example 1 except that this solid center was used, wound golf balls were prepared to the specifications shown in Table 1. The golf balls were similarly evaluated, with the results shown in Table 1.

Example 3

A mixture of high cis polybutadiene rubber/zinc white/zinc acrylate/dicumyl peroxide in a weight ratio of 100/5.5/10/1.5 was fully milled and vulcanized at 160° C. for 20 minutes to form a solid center. By the same procedure as in Example 1 except that this solid center was used, wound golf balls were prepared to the specifications shown in Table 1. The golf balls were similarly evaluated, with the results shown in Table 1.

Example 4

A mixture of high cis polybutadiene rubber/zinc white/zinc acrylate/barium sulfate/dicumyl peroxide in a weight ratio of 100/5/10/5/1.5 was fully milled and vulcanized at 160° C. for 20 minutes to form a solid center. By the same procedure as in Example 1 except that this solid center was used, wound golf balls were prepared to the specifications shown in Table 1. The golf balls were similarly evaluated, with the results shown in Table 1.

Example 5

As in Example 2, golf balls were prepared to the specifications shown in Table 1. The golf balls were similarly evaluated, with the results shown in Table 1.

Examples 6 and 7

A liquid center was prepared by milling a mixture of natural rubber/zinc white/stearic acid/sulfur/vulcanization accelerator/antioxidant in a weight ratio of 100/35/2/2/1.5/1 to form a soft vulcanizable rubber blend having a specific gravity of about 1.18 as a sheet of about 2 mm thick and shaping it into a pair of semi-vulcanized semi-spherical cups having a diameter of about 28 mm. Barium sulfate and ethylene glycol were added to water to form a paste. The semi-spherical cups were mated to form a sphere which was filled with the paste. The cups were welded together and vulcanized in a mold.

By the same procedure as in Example 1 except that this liquid center was used, wound golf balls were prepared to the specifications shown in Table 1. The golf balls were similarly evaluated, with the results shown in Table 1.

Example 8

The golf ball was prepared in the same procedure as in Example 1 except that the hardness of the cover and the total volume of the dimples were changed as shown in Table 1.

Comparative Examples 1–5

Wound golf balls were similarly prepared in which the center was heavier than the thread rubber and the ball outer diameter was less than 42.9 mm. The golf balls were similarly evaluated, with the results shown in Table 1. Note that Comparative Examples 2 and 3 were commercially available golf balls which were disassembled to measure the weight of thread rubber and center. Comparative Examples 1–3 and 5 had a solid center and Comparative Example 4 had a liquid center.

Comparative Examples 6–8

The golf balls were prepared in the same procedure as in Example 1 except that the hardness of the cover and the total volume of the dimples were changed as shown in Table 1.

TABLE 1

| | Example | | | | | | | | Comparative Example | | | | | | | |
|---|---|---|---|---|---|---|---|---|---|---|---|---|---|---|---|---|
| | 1 | 2 | 3 | 4 | 5 | 6 | 7 | 8 | 1 | 2 | 3 | 4 | 5 | 6 | 7 | 8 |
| Center | | | | | | | | | | | | | | | | |
| Type | solid | solid | solid | solid | solid | liquid | liquid | solid | solid | solid | solid | liquid | solid | solid | solid | solid |
| Diameter(mm) | 27.6 | 27.6 | 27.6 | 30.0 | 27.6 | 27.8 | 27.8 | 27.6 | 27.6 | 30.2 | 31.5 | 27.8 | 32.0 | 27.6 | 27.6 | 27.6 |
| Weight(gram) | 16.7 | 14.2 | 14.0 | 14.4 | 14.2 | 16.6 | 11.9 | 16.7 | 17.5 | 20.5 | 21.6 | 17.6 | 19.6 | 16.7 | 16.7 | 16.7 |
| Wound core | | | | | | | | | | | | | | | | |
| Diameter(mm) | 39.6 | 40.6 | 40.2 | 41.6 | 40.6 | 39.6 | 41.6 | 39.6 | 39.2 | 39.0 | 39.0 | 39.3 | 40.4 | 39.6 | 39.6 | 39.6 |
| Weight(gram) | 34.1 | 33.7 | 32.3 | 33.2 | 33.7 | 34.1 | 33.3 | 34.1 | 34.1 | 34.6 | 35.8 | 34.4 | 33.2 | 34.2 | 34.1 | 34.1 |
| Weight difference* (gram) | 0.7 | 5.3 | 4.3 | 4.4 | 5.3 | 0.9 | 9.5 | 0.7 | −0.9 | −6.4 | −7.4 | −0.8 | −6.0 | 0.8 | 0.7 | 0.7 |
| Cover | | | | | | | | | | | | | | | | |
| Shore D hardness (degree) | 66 | 66 | 66 | 66 | 58 | 66 | 67 | 54 | 66 | 66 | 66 | 67 | 66 | 50 | 66 | 66 |

TABLE 1-continued

| | Example | | | | | | | | Comparative Example | | | | | | | |
|---|---|---|---|---|---|---|---|---|---|---|---|---|---|---|---|---|
| | 1 | 2 | 3 | 4 | 5 | 6 | 7 | 8 | 1 | 2 | 3 | 4 | 5 | 6 | 7 | 8 |
| Thickness | 1.8 | 1.8 | 2.0 | 1.8 | 1.8 | 1.9 | 1.9 | 1.8 | 1.8 | 2.0 | 2.0 | 1.9 | 1.8 | 1.8 | 1.8 | 1.80 |
| Dimple | | | | | | | | | | | | | | | | |
| Total volume ($mm^3$) | 320 | 340 | 360 | 380 | 340 | 320 | 380 | 360 | 320 | 360 | 320 | 320 | 360 | 320 | 280 | 420 |
| Completed ball | | | | | | | | | | | | | | | | |
| Diameter(mm) | 43.0 | 44.0 | 44.0 | 45.0 | 44.0 | 43.0 | 45.0 | 43.0 | 42.7 | 42.7 | 42.7 | 42.7 | 44.0 | 43.0 | 43.0 | 43.0 |
| Weight(gram) | 45.3 | 45.3 | 45.4 | 45.3 | 45.3 | 45.2 | 45.4 | 45.2 | 45.2 | 45.4 | 45.6 | 45.3 | 45.3 | 45.4 | 45.3 | 45.3 |
| Hardness(mm) | 2.80 | 2.90 | 2.80 | 2.80 | 2.95 | 2.80 | 2.70 | 2.83 | 2.85 | 2.80 | 2.75 | 2.80 | 2.73 | 2.85 | 2.80 | 2.80 |
| MOI, $g \cdot cm^2$ | 79.12 | 87.70 | 86.12 | 93.14 | 85.59 | 79.13 | 92.85 | 79.10 | 76.99 | 78.51 | 78.90 | 76.02 | 87.70 | 79.15 | 79.12 | 79.12 |
| Coefficient of repulsion | 0.786 | 0.789 | 0.789 | 0.791 | 0.783 | 0.783 | 0.783 | 0.771 | 0.778 | 0.772 | 0.764 | 0.772 | 0.771 | 0.755 | 0.786 | 0.786 |
| Flying characeristics | | | | | | | | | | | | | | | | |
| Initial speed(m/s) | 59.8 | 59.9 | 59.9 | 60.0 | 59.8 | 59.8 | 59.8 | 59.3 | 59.6 | 59.4 | 59.1 | 59.4 | 59.2 | 59.0 | 59.8 | 29.9 |
| Ejection angle(degree) | 10.3 | 10.3 | 10.3 | 10.4 | 10.3 | 10.5 | 10.6 | 10.3 | 10.0 | 10.2 | 9.7 | 10.1 | 10.1 | 9.9 | 10.3 | 10.3 |
| Spin(rpm) | 3200 | 3170 | 3140 | 3110 | 3250 | 3130 | 3080 | 3350 | 3440 | 3350 | 3800 | 3300 | 3380 | 3750 | 3180 | 3210 |
| Elevation angle(degree) | 12.1 | 12.3 | 12.1 | 12.2 | 12.4 | 12.0 | 12.3 | 12.0 | 12.5 | 11.8 | 12.7 | 12.4 | 11.7 | 12.8 | 12.7 | 11.7 |
| Carry(m) | 180.8 | 182.1 | 181.5 | 182.3 | 181.6 | 180.3 | 183.1 | 180.5 | 178.1 | 179.3 | 176.0 | 176.5 | 177.4 | 175.5 | 175.2 | 176.3 |
| Total(m) | 196.3 | 196.8 | 198.0 | 197.4 | 194.0 | 197.0 | 197.5 | 196.0 | 191.6 | 193.2 | 187.8 | 192.6 | 191.3 | 187.2 | 190.3 | 191.5 |
| Feeling | good | good | good | good | good | good | good | good | fair | hard | hard | fair | hard | good | good | good |

*weight difference = thread rubber layer − center

As is evident from Table 1, the wound golf balls of the invention are characterized by an improved feeling on impact, an increased coefficient of repulsion, an increased initial speed, a high ejection angle, and controlled spin so that they travel along a trajectory approximate to two-piece golf balls to provide an increased flying distance. They also give a soft feeling, contrary to the known fact that solid center wound golf balls are hard on hitting and in this regard resemble to two-piece golf balls.

The thread-wound golf ball of the invention in which the ball is enlarged to a diameter of 42.9 to 46 mm to allow the thread rubber content to be increased achieves an increase of flying distance through improved repulsion, an increased initial speed, reduced spin, and an increased ejection angle. The ball offers a satisfactory flying distance and a pleasant feeling on impact even when it is hit by less powerful players who swing at a slow head speed. The ball is unlikely to sink in the grass and is easier to hit.

Although some preferred embodiments have been described, many modifications and variations may be made thereto in the light of the above teachings. It is therefore to be understood that within the scope of the appended claims, the invention may be practiced otherwise than as specifically described.

I claim:

1. A thread-wound golf ball comprising a wound core consisting of a center and a thread rubber layer thereon, and a cover enclosing the core and having a plurality of dimples thereon, wherein the thread rubber layer has a thickness of 5 to 9 mm and a larger weight than the center of said core, said cover is made of an ionomer resin and has a thickness of 1 to 2.5 mm and a Shore D hardness of 52 to 68, and the ball has an outer diameter of 42.9 to 46 mm and the total volume of dimples of 300 to 400 $mm^3$.

2. The golf ball of claim 1 wherein the thread rubber layer is heavier than the center of said core by 0.1 to 15 grams.

3. The golf ball of claim 2 wherein the ball has an outer diameter of 44 to 46 mm and the thread rubber layer is heavier than the center of said core by 1 to 10 grams.

4. The golf ball of claim 1 wherein the center has a weight of 8 to 18 grams and a diameter of 24 to 32 mm, and the thread rubber layer has a weight of 16 to 26 grams and a thickness of 5 to 9 mm.

* * * * *